US009445681B2

(12) United States Patent
Robbins, III et al.

(10) Patent No.: US 9,445,681 B2
(45) Date of Patent: Sep. 20, 2016

(54) ANTI-FATIGUE CHAIR MAT

(71) Applicant: Edward S. Robbins, III, Muscle Shoals, AL (US)

(72) Inventors: Edward S. Robbins, III, Muscle Shoals, AL (US); Milton F. Bain, Jr., Muscle Shoals, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 0 days.

(21) Appl. No.: 14/631,487

(22) Filed: Feb. 25, 2015

(65) Prior Publication Data

US 2015/0238036 A1 Aug. 27, 2015

Related U.S. Application Data

(60) Provisional application No. 61/944,251, filed on Feb. 25, 2014.

(51) Int. Cl.

| | |
|---|---|
| ***B32B 3/30*** | (2006.01) |
| ***A47G 27/02*** | (2006.01) |
| ***A47C 7/02*** | (2006.01) |
| ***A47C 7/18*** | (2006.01) |

(52) U.S. Cl.

CPC ..... *A47G 27/0231* (2013.01); *A47C 7/021* (2013.01); *A47C 7/18* (2013.01); *Y10T 428/24025* (2015.01)

(58) Field of Classification Search

CPC ..... A47G 27/0206; A47G 27/0231; Y10T 428/24215; Y10T 428/24174

USPC ..... 428/119, 121

See application file for complete search history.

(56) References Cited

U.S. PATENT DOCUMENTS

| | | | | |
|---|---|---|---|---|
| 2,931,685 | A | 4/1960 | Butler | |
| 4,784,888 | A | 11/1988 | Schwertner et al. | |
| 5,088,421 | A | 2/1992 | Beckstead | |
| 5,174,223 | A | 12/1992 | Nagy et al. | |
| 5,645,914 | A | 7/1997 | Horowitz | |
| 6,183,833 | B1 | 2/2001 | Robbins, III et al. | |
| 6,284,341 | B1 | 9/2001 | Robbins, III et al. | |
| 6,554,782 | B2 | 4/2003 | Robbins, III et al. | |
| 6,579,250 | B2 | 6/2003 | Robbins, III et al. | |
| 6,851,141 | B2 | 2/2005 | McMahan | |
| 7,445,833 | B2 | 11/2008 | Polley | |
| 7,993,726 | B2 | 8/2011 | Johnson et al. | |
| 8,075,971 | B1 * | 12/2011 | Horian | B32B 3/08 428/61 |
| 2012/0288663 | A1 | 11/2012 | Sabry | |

* cited by examiner

*Primary Examiner* — Alexander Thomas
(74) *Attorney, Agent, or Firm* — Brinks Gilson & Lione

(57) ABSTRACT

A chair mat especially designed for use in both a sitting and standing position can have a substantially rigid base including a fold line separating a first portion of the base from a second portion. A resilient cushion can positioned on only the second portion lower surface of the base. The second portion can be movable about the fold line relative to the first portion between a first position where the cushion is downwardly facing and a second position where the cushion is upwardly facing. When the second portion is in the first position, the substantially rigid base can present a substantially continuously smooth upper surface providing for easy movement of any casters or rollers supporting a desk chair spider. When the second portion is in the second position, the cushion can provide a compressible yet resilient portion that facilitates a comfortable standing working position for prolonged periods of time.

20 Claims, 7 Drawing Sheets

ANTI-FATIGUE CHAIR MAT

PRIORITY

This application claims priority to U.S. Provisional Patent Application No. 61/944,251, filed Feb. 25, 2014, which is incorporated herein by reference in its entirety.

BACKGROUND

1. Field

This disclosure relates to chair mats designed for use in both a seated position and a standing position.

2. Background

The need for vertical adjustment of a work surface for a work desk has long been recognized. Both the productivity and the comfort level of the user are increased if the height of the work surface can be adjusted to fit the needs of a particular individual. Elaborate arrangements for such height adjustments have long been prevalent in such diverse areas as operating tables and drafting tables. For some jobs the ability to switch between the standing and sitting position acts to relieve fatigue and improve productivity. If a work desk is to be adapted for use in both the standing and the sitting position, it is necessary to make a substantial vertical adjustment of the height of the work surface. Along with any adjustment in the height of the work surface, the switch between the standing and sitting position places different support demands on the worker.

Conventional work desk seating typically is supplied by a cushioned chair or stool that includes a spider floor support including a plurality of casters to allow for some movement of the seating device relative to the work desk. Often a desk chair mat is provided to facilitate that movement. While such a chair mat can be rectangular or square, some chair mats can have a main portion on which the desk chair rolls, and can include a forward lip portion which is adapted to extend partially into a desk well, and on which the feet of the person sitting in the chair can rest. A desk chair mat that is to be applied over carpeting is typically formed of a semi-rigid to rigid plastic, and has an array of short spikes on an underside thereof, which hold the mat firmly in place on the carpeting. While desk chair mats can be made without any such spikes, such mats tend to move relative to the carpet in response to movement of any desk chair on the top surface of the mat. Thus a carpet-engaging structure can be deemed desirable to achieve satisfactory performance on carpet surfaces, but may be unnecessary when used on smooth surfaced floors.

As indicated previously, most desk chair mats are formed of a semi-rigid to rigid plastic, which provides the desirable upper surface for easy movement of the casters or other rollers supporting a desk chair spider, but can be undesirably uncomfortable for any prolonged standing. Thus, there remains a need for a desk chair mat especially suited for use in both the sitting and standing position, particularly in conjunction with work desks adapted for use in both the standing and the sitting position.

SUMMARY

A chair mat especially designed for use in both a sitting and standing position can be formed of a substantially rigid base having an upper surface and a lower surface. A fold line can be provided to separate a first portion of the base from a second portion of the base. A resilient cushion can be disposed on only a lower surface of the second portion of the base. The second portion can be movable about the fold line relative to the first portion between a first position where the cushion is downwardly facing and a second position where the cushion is upwardly facing. When the second portion is in the first position where the cushion is downwardly facing, the substantially rigid base can present a substantially continuously smooth upper surface providing for easy movement of any casters or other rollers supporting a desk chair spider. When the second portion is in the second position where the cushion is upwardly facing, the cushion can provide a compressible yet resilient portion that facilitates a comfortable standing working position for prolonged periods of time.

In one embodiment, the base can be a unitary one-piece sheet of molded plastic. The lower surface of the first portion of the base can be generally planar so as to be suitable for use on a smooth surface floor, such as tile or wood, or a roughened surface floor, such as a carpet. Optionally, the lower surface of the first portion of the base can include a plurality of ribs for use to engage either a roughened surface floor such as a carpet, or a smooth surface floor, such as tile or wood to minimize slippage. As another option, the lower surface of the first portion of the base can include carpet-engaging protrusions for use on a carpeted floor. In an example embodiment, the fold line can be included as part of the base, and can be formed by one or more regions of lesser thickness than the rest of the base, which will facilitate the displacement of the second portion relative to the first portion. In other embodiments, other forms of hinge mechanism can be used to facilitate the displacement of the second portion relative to the first portion. The base can be formed for example from any convenient semi-rigid or rigid plastic, such as PVC, polypropylene and other thermoplastics.

In an embodiment, the cushion can exhibit a 25% compression deflection in the range of between 30 and 35 psi. In an embodiment, the cushion can be secured to the lower surface of the second portion of the base for example by cementing, ultrasonically bonding or other similar fixed attachment, or by removable bonding materials such as strips, such as Velcro strips. In embodiments, the cushion can be formed, for example, from a foam polymer selected from TPU, EVA, PE, PP, PVC, and natural or synthetic rubber, with or without a protective or decorative skin coating. The cushion can also be formed from a plastic article mechanically designed to produce the desired compression deflection, selected from a material comprising PVC, EVA, Olefin, TPU, and natural or synthetic rubber, or alloys of the same. Alternatively, or in addition, the cushion can be formed to include an internal cavity within which a liquid, such as water or gel, and/or a gas, such as air, may be contained. The cushion can also be formed to be integral with the base, such as being formed between plys of a multi-ply thermoplastic base.

A feature of the chair mat is the dimensioning and positioning of the fold line so that it generally underlies a front edge of the desk with which it is used. This positioning has the advantage to allowing the user of such a chair mat to transform between the sitting position and the standing position without moving the first portion of the chair mat relative to the floor.

Another feature of the chair mat is embodiments of the fold line that include ribs and/or a foot. The ribs and the foot can be formed as integral part of the fold line, and/or the base to provide supporting structural members for the fold line to substantially maintain the positioning of the fold line with respect to the floor surface as a downward force is applied in the vicinity of the fold line by another object, such as a roller of a desk chair, and/or a human. The ribs can provide additional rigidity to the base so that the base does not bow, sag, or warp. The foot provides a rigid structural member contacting the floor in the vicinity between fold line and the cushion so that the cushion does not compress between the floor and the portion of the base adjacent to the foot, thereby avoiding undesirable displacement of the base towards the floor due to compression of the cushion adjacent to the fold line.

The above, as well as other features and advantages, will become readily apparent to those skilled in the art from the following detailed description of a preferred embodiments when considered in the light of the accompanying drawings.

DESCRIPTION OF PREFERRED EMBODIMENTS

Figure 1:
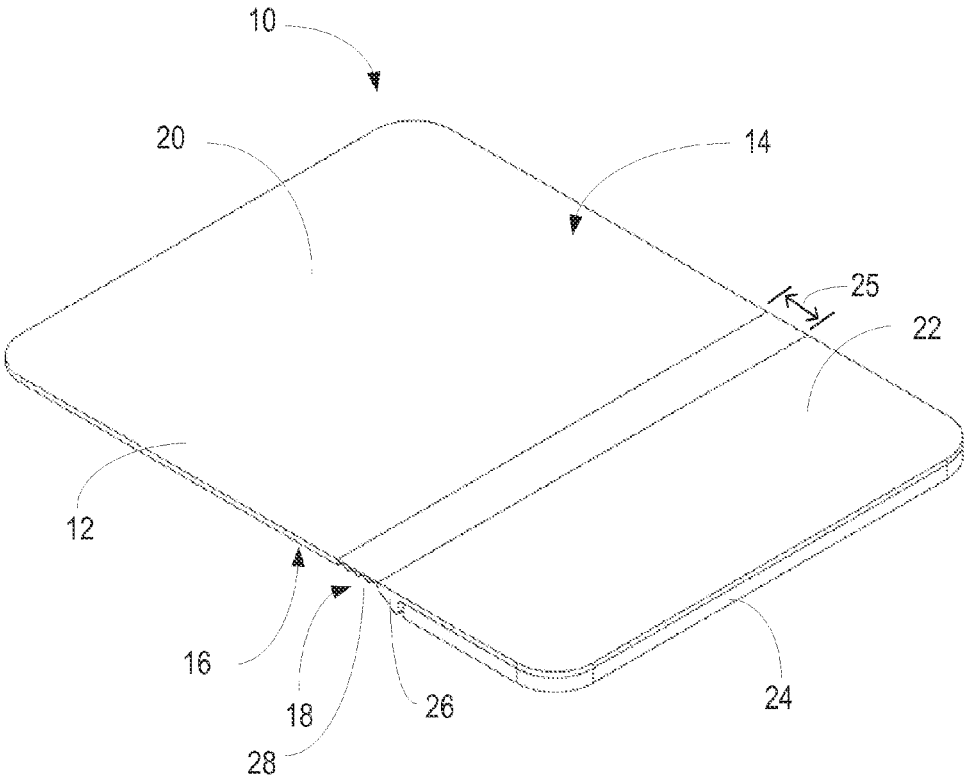
FIG. 1 is an orthogonal view of an example embodiment of a chair mat especially designed for use in both a sitting and standing position.

With reference to all the drawings, the same reference numerals are generally used to identify like components. FIG. 1 shows a chair mat 10 especially designed for use in both a sitting and standing position. The chair mat 10 can include a substantially rigid base 12 having an upper surface 14 and a lower surface 16. A fold line 18 can be provided to separate a first portion 20 of the base 12 from a second portion 22 of the base 12. A resilient cushion 24 can be positioned only on the second portion 22 on the lower surface 16 of the base 12. The base 12 can be formed, for example, from any convenient semi-rigid or rigid plastic, such as PVC, polypropylene, and other thermoplastics.

The fold line 18 can be a hinge mechanism that allows bending to facilitate displacement of the second portion 22 relative to the first portion 20. Thus, in an embodiment where the base 12 is formed as a unitary one-piece sheet of molded plastic that includes the first portion 20 and the second portion 22, the fold line 18 can be formed to provide repetitive bending by having one or more creases or score lines included in the base 12. In an embodiment, the fold line 18 in the base 12 can be formed by one or more regions 25 of lesser thickness than the rest of the base 12, as illustrated in FIGS. 1-2, 6-7, and 8-9, which will facilitate the displacement of the second portion 22 relative to the first portion 20. In other embodiments, the material of the unitary sheet of the base 12 in the proximity forming the fold line 18 may be a flexible material of greater or lesser thickness than the base 12, to facilitate bending. In still another embodiment, the first portion 20 and the second portion 22 of the base 12 may be separated and the first and second portions 20 and 22 may be coupled together by a flexible material or a hinge mechanism that allows displacement of the second portion 22 relative to the first portion 20 as described herein. In these embodiments, the coupling may be by cementing, ultrasonically bonding or other similar fixed attachment means.

Figure 2:
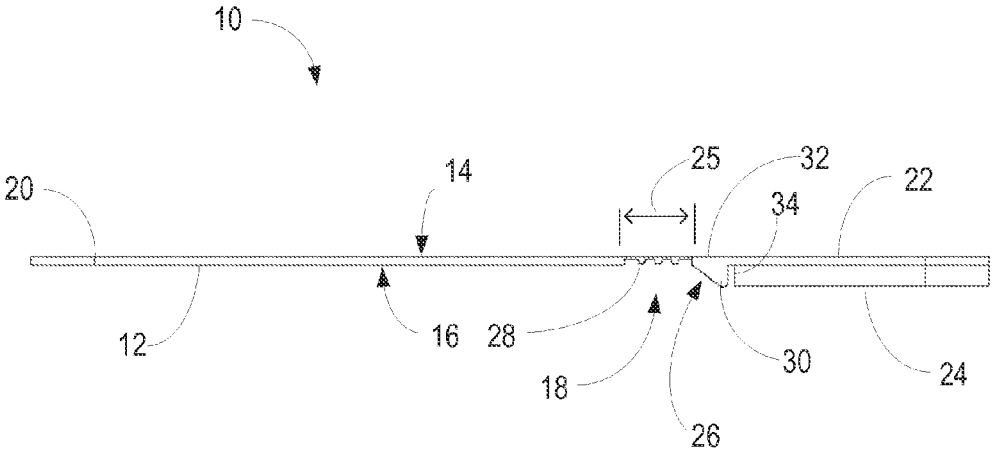
FIG. 2 is a side elevation view of an example embodiment of a chair mat.
Figure 6:
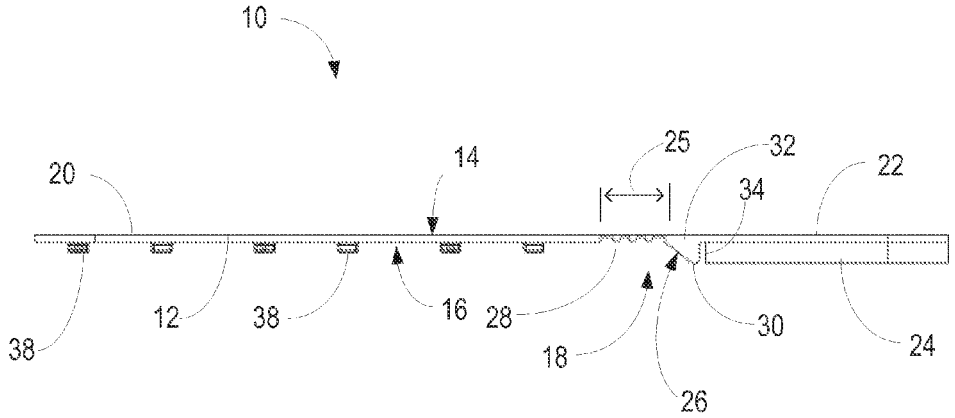
FIG. 6 is a side elevation view an example embodiment of a chair mat especially designed for use in both a sitting and standing position including a plurality of protrusions.
Figure 8:
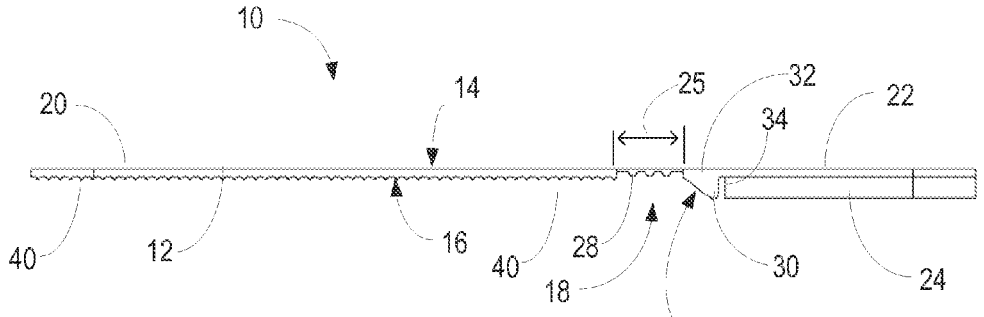
FIG. 8 is a side elevation view an example embodiment of a chair mat especially designed for use in both a sitting and standing position including a plurality of ribs.

The fold line 18 can include a foot 26 and one or more ribs 28. The foot 26 can be one or more rigid structures protruding from the lower surface 16 of the base 16. In the illustrated embodiment, the foot 26 is integrally formed with the base 16. In other example embodiments, the foot 26 may be one or more separate structures, which are fixedly coupled with the base 12, for example by cementing, ultrasonically bonding or other similar fixed attachment means. As illustrated in FIGS. 2, 6, and 8 the foot 26 can be generally triangular in shape such that a protruding end 30 of the foot forms a contact point with the floor, and a base 32 of the foot 26 is integral with, or fixedly coupled with the lower surface 16 of the second portion 22. In an embodiment, the foot 26 can extend across the width of the second portion 22 of the base 12. In other embodiments, the foot 26 may be a series of feet sequentially spaced across the width of the second portion 22.

Figure 3:
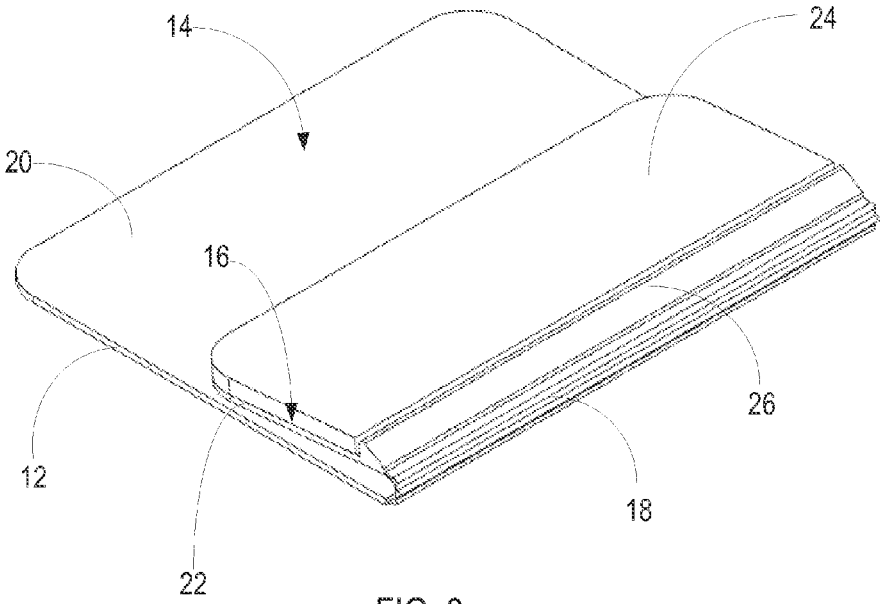
FIG. 3 is an orthogonal view of an example embodiment of a chair mat, folded so that the cushion is upwardly facing.
Figure 4:
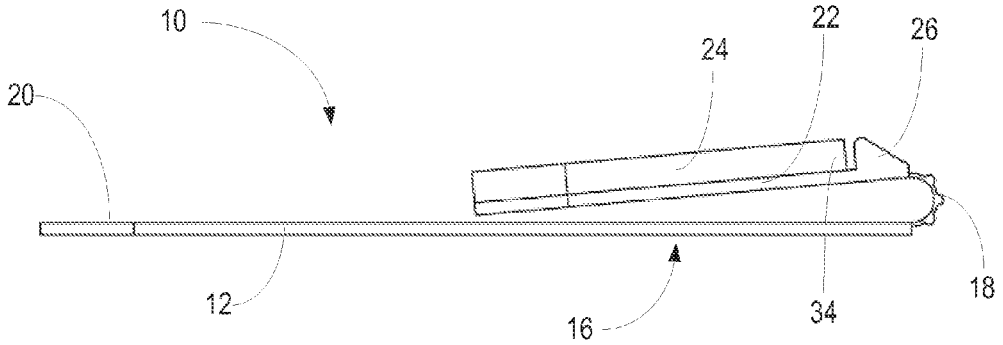
FIG. 4 is a side elevation view of an example embodiment of a chair mat.
Figure 5:
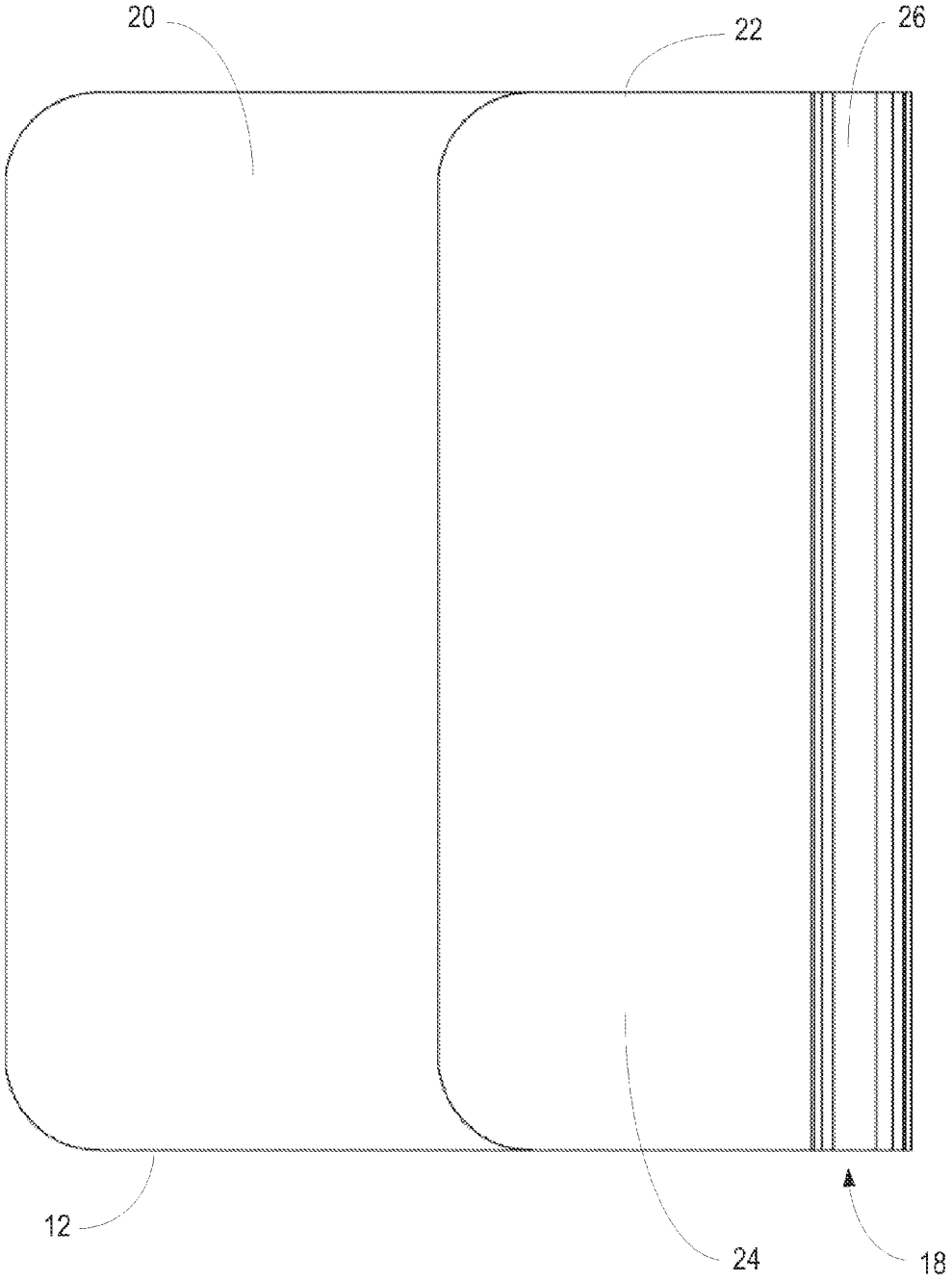
FIG. 5 is a top view of an example embodiment of a chair mat, folded so that the cushion is upwardly facing.
Figure 10:
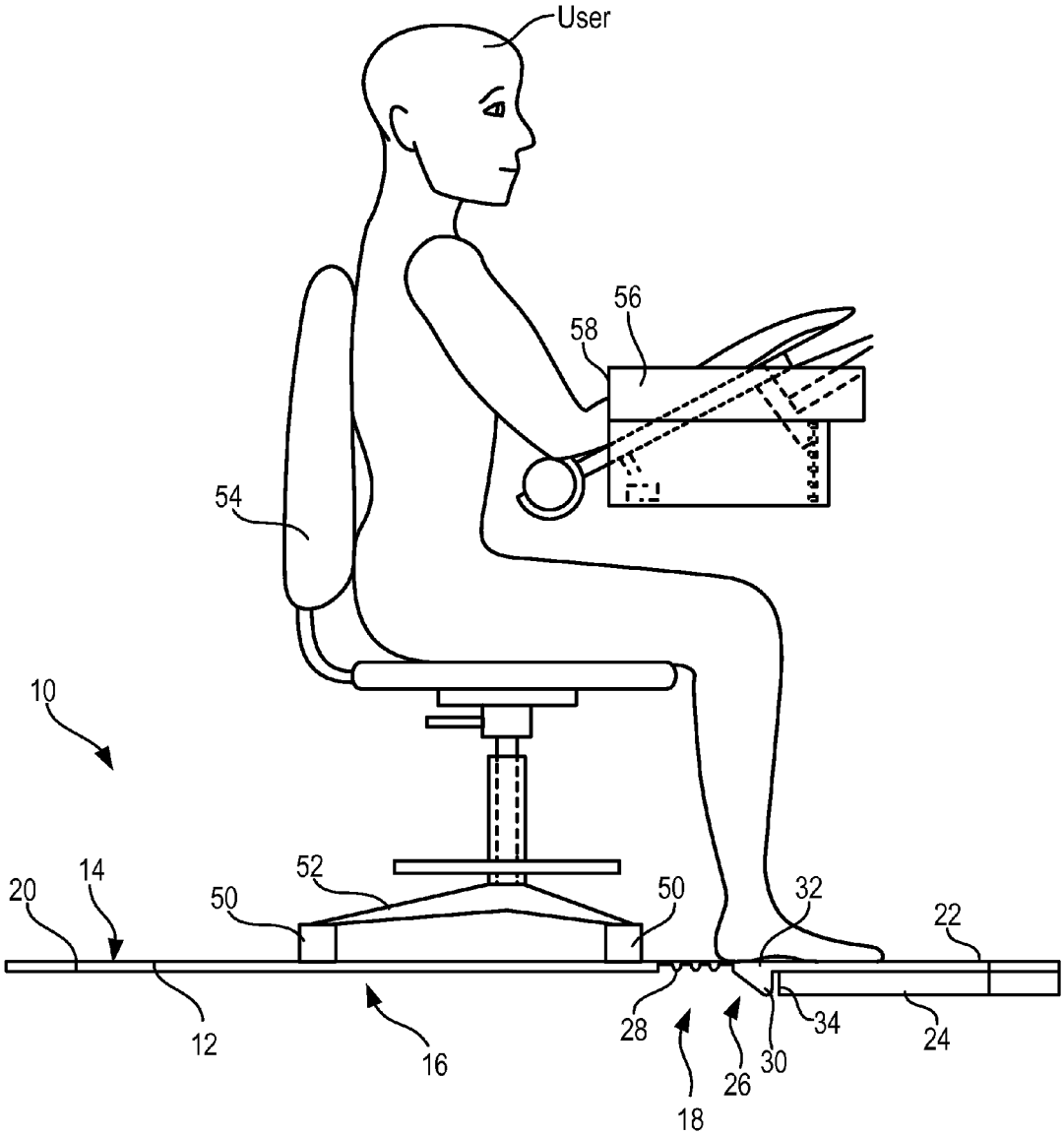
FIG. 10 is caricature of a user illustrating example use of an embodiment of the chair mat in a sitting position.
Figure 11:
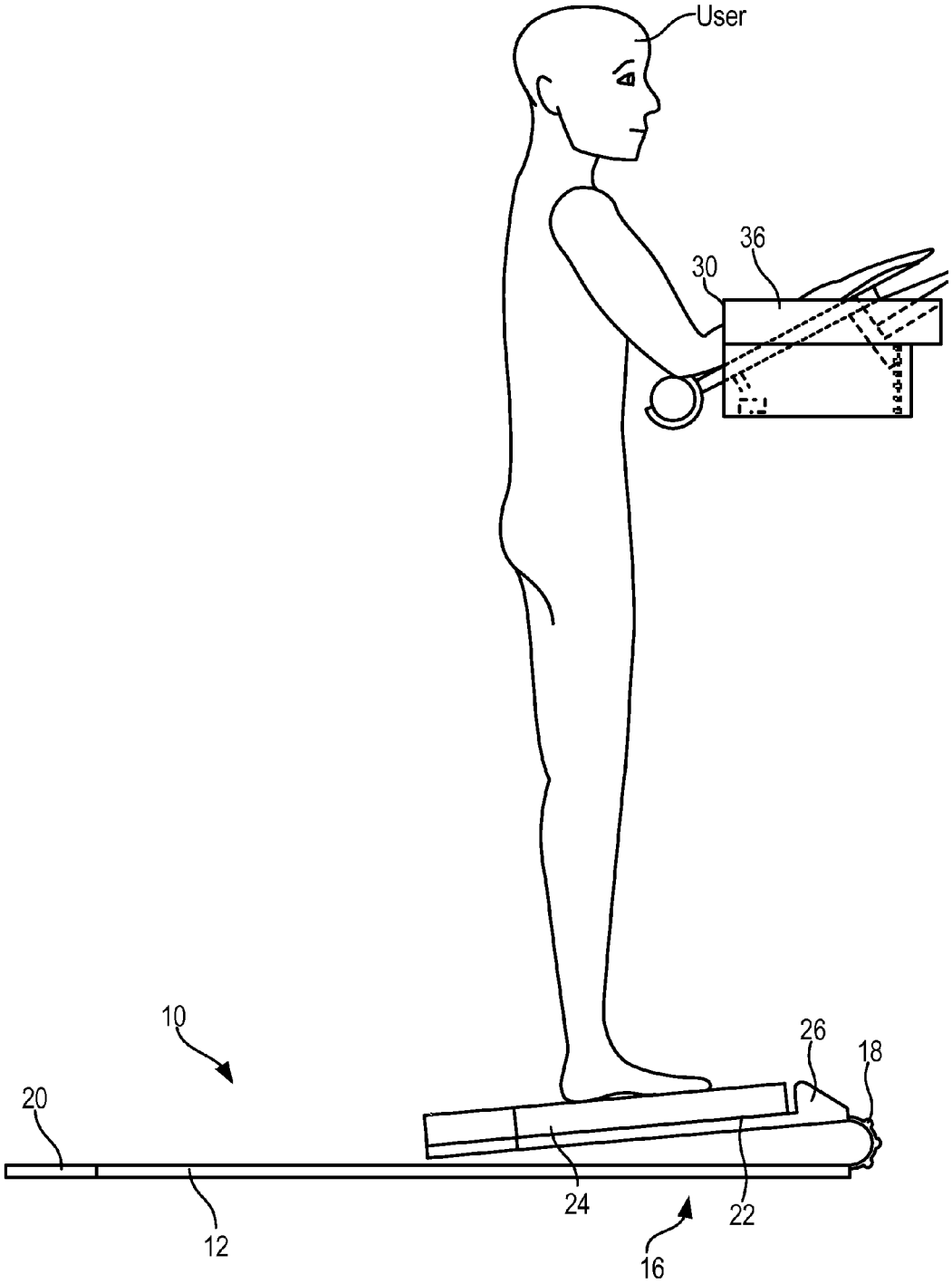
FIG. 11 is caricature of a user illustrating example use of an embodiment of the chair mat in a standing position.

The second portion 22 can be movable about the fold line 18 relative to the first portion 20 between a first position where the cushion 24 is downwardly facing, as shown in FIGS. 1 and 2, and a second position, shown in FIGS. 3, 4 and 5, where the cushion 24 is upwardly facing. When the second portion 22 is in the first position where the cushion 24 is downwardly facing, the substantially rigid base 12 can present an upper surface 14 that is substantially continuously smooth to provide for easy movement of any casters 50 or other rollers supporting a spider 52 of a desk chair 54, when a desk 56 is positioned at a sitting height, for example as shown in FIG. 10, where the second portion 22 is situated under the desk 56 with the fold line 18 situated vertically under a front edge 58 of the desk 56. When the second portion 22 is in the second position where the cushion 24 is upwardly facing, the cushion 24 is situated in front of the front edge 58 of the desk 56 so that the cushion 24 can provide a compressible yet resilient portion that for prolonged periods of time facilitates a comfortable standing working position, for example as shown in FIG. 11. The second portion may vary in the depth direction to accommodate different size desks 56. In other example embodiments, the second portion 22 can include multiple fold lines 18 to allow stacking of the parts of the second portions between the fold lines 18, such as one upon the next ("accordion" or "z" fold, multi-fold). Such stacking may be used, for example, to change the height of the second portion 22, while the second portion 22 is in the first position or the second position, and/or to allow a more compact form for placement under a desk, or for storage or shipment of the chair mat 10. Although the fold line 18 is illustrated in FIGS. 3-4, and 11 as creating an air space when the second portion 22 is folded over in the second position as illustrated in FIG. 5, in embodiments, the air space may not be present, and/or could be present until the chair mat 10 is subject to the weight of a user. Thus, in embodiments, the first portion 20 and the second portion 22 are generally positioned in substantially parallel planes when the second portion 22 is in the second position as illustrated in FIG. 5.

As illustrated in FIGS. 2, 4, 6 and 8 the protruding end 30 of the foot 26 can extend away from the lower surface 16 substantially the same distance as the cushion 24 extends away from the lower surface 16. Thus, the foot 26 can extend from the lower surface to the floor surface upon which the chair mat is positioned when the second portion 22 is in the first position, and the foot extends in the opposite direction when the second portion 22 is in the second position. When the second portion 22 is in the first position, an adjacently located edge 34 of the cushion 24 is not subject to compressive forces between the bottom surface 16 and the floor when a downward force is applied to upper surface 14 of the second portion 22 of the base 12. Due to the support provided by the foot 26 and the corresponding absence of compressive forces on the cushion 24 near the edge 34, the folding line 18 is not subject to undesirable flexing when the second portion 22 is positioned as illustrated in FIG. 2. Thus, the upper surface 14 can be maintained as a substantially planar flat smooth surface to allow casters or other form of rollers to easily roll.

Figure 7:
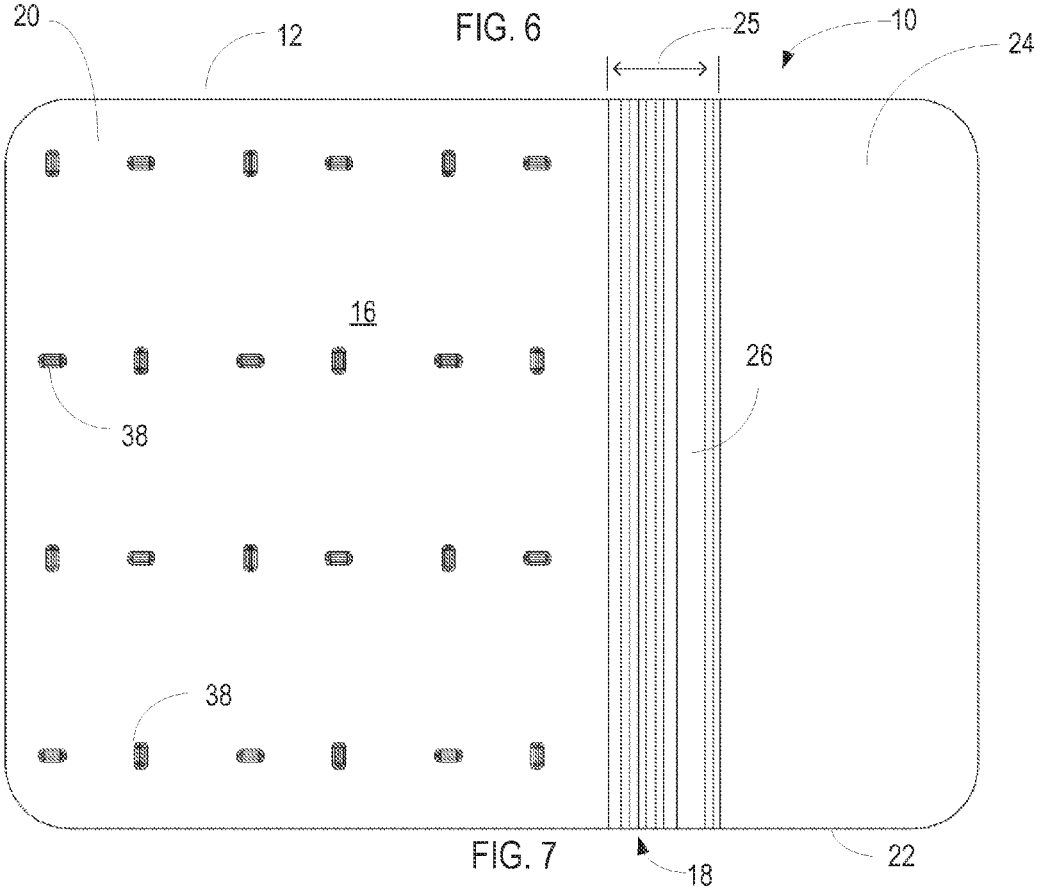
FIG. 7 is a bottom plan view of an example embodiment of the chair mat shown in FIG. 6.

The base 12 can be formed by a unitary one-piece sheet of molded plastic. The lower surface 16 of the first portion 20 of the base 12 can be generally planar so as to be suitable for use on a smooth surface floor. Optionally, in an embodiment, the lower surface 16 of the first portion 20 of the base 12 can include a plurality of protrusions 38, as shown in FIGS. 6 and 7. The protrusions 38 can be positioned in a predetermined pattern on the lower surface 16 to extend perpendicularly away from the lower surface 16 a predetermined distance to engage a roughened surface material, such as carpeting, upon which chair mat 10 is placed. Thus, the protrusions 38 may be referred to as carpet engaging protrusions 38. The protrusions 38 may be integrally formed as part of the base 12, or may be coupled with the lower surface by cement, welding, or another fixed coupling technique. The form, shape, arrangement and density of the carpet-engaging protrusions 26 can be subject to choices of designs.

Figure 9:
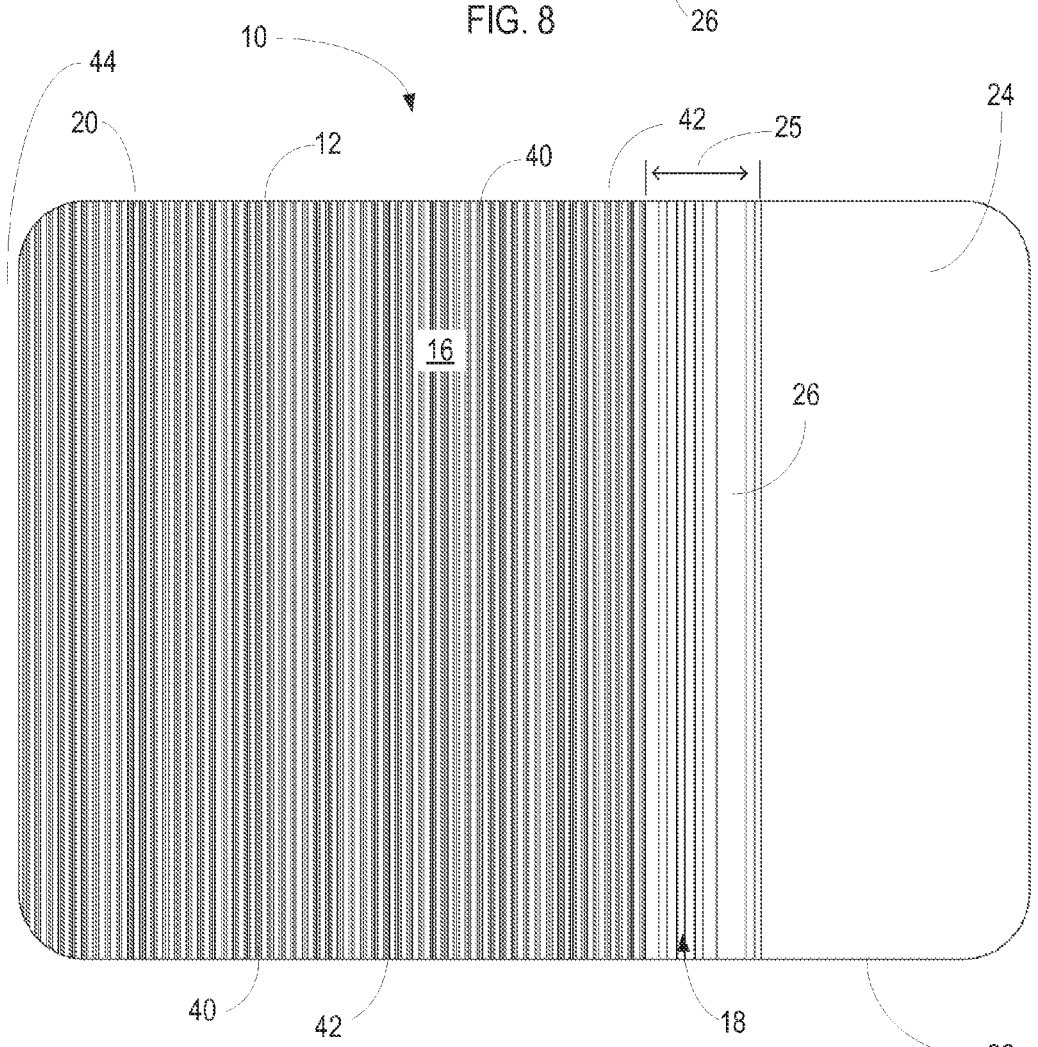
FIG. 9 is a bottom plan view of an example embodiment of the chair mat shown in FIG. 8.

Optionally, in another embodiment, the lower surface 16 of the first portion 20 of the base 12 can include a plurality of ribs 40, as shown in FIGS. 8 and 9. The ribs 40 can extend at least a portion of the width of the first section 20 between first and second peripheral edges 42 of the first portion 20, and be sequentially spaced in rows between the fold line 18 and a peripheral edge 44 of the first portion 20, opposite the fold line 18. The ribs 40 can be a raised generally triangular structure that is integrally formed with the base 12 such that the base of the triangular structure is part of the base 12 and a point of the triangular structure extends away from the lower surface 16 a predetermined distance. Each of the ribs 40 may be formed as a single structure extending between the first and second peripheral edges 42, or may be a series of individual triangular structures spaced away from each other such that a series of ribs 40 form a line between the peripheral edges 42. The spacing of the ribs 40 between the peripheral edges 42 and between the fold line 18 and the peripheral edge 44 may be uniform, or non-uniform. The ribs 40 may be positioned on the lower surface 16, and formed to engage the surface of the flooring material upon which the chair mat 10 is placed. Thus, the ribs 40 may engage and maintain the position of the chair mat on the flooring surface, whether the flooring is a roughened surface such as carpeting, or a smooth surface such as wood flooring, tile flooring, or linoleum flooring, for example.

The cushion 24 can be formed, for example, from a foam polymer selected from TPU, EVA, PE, PP, PVC, and natural or synthetic rubber, with or without a protective and/or decorative skin coating; or from a molded plastic article mechanically designed to give anti-fatigue properties and produced from a material comprising PVC, EVA, Olefin, TPU, and natural or synthetic rubber, or alloys of the same. Alternatively, or in addition, the cushion can be formed to include an internal cavity within which a liquid, such as water or gel, and/or a gas, such as air, may be contained. The cushion can also be formed to be integral with the base, such as being formed between two or more plys of a multi-ply thermoplastic base 12.

In embodiments, the cushion 24 can exhibit a 25% compression deflection in the range of between 30 and 35 psi. In addition, in embodiments, the cushion 24 can be fixed, or secured, to only the lower surface 16 of the second portion 22 of the base 12, for example, by cementing, ultrasonically bonding or other similar fixed attachment, or by removable attachment using snaps or bonding strips such as Velcro. In the example of removable attachment of the cushion 24, different thicknesses of cushions 24 may be coupled with the second portion 22 of the base 12, to adjust the distance the cushion 24 extends away from the lower surface 16 of the second portion 22 of the base 12. Further, in embodiments where the cushion 24 includes a cavity, the cavity may include a nozzle or orifice that allows adjustment of the amount of liquid or gas present in the cavity. A user can change the amount of liquid or gas present in the cavity to adjust the compression deflection of the cushion 24. In addition, or alternatively, the distance that the cushion 24 extends away from the lower surface 16 of the second portion 22 of the base 12 may be adjusted by changing the amount of liquid or gas present in the cavity.

Adjustment in the distance the cushion 24 extends away from the lower surface 16 of the second portion 22 of the base 12 can allow for adjustment of the second portion for use in both the first position where the user sits, and in the second position where the user stands as illustrated in FIGS. 10 and 11. For example, in the first position where the user sits, the adjustment in the distance the cushion extends away can be adjusted to change the elevation of the user's feet above the floor surface to achieve an ergonomically and/or comfortable position. In another example, in the second position where the user stands, the adjustment of the distance the cushion 24 extends away can change the elevation of the user with respect to the desk surface to achieve an ergonomically and/or comfortable position. Also, the degree of compression deflection of the cushion 24 in the second position can be adjusted by changes in the amount of liquid or gas present in the cavity, to, for example, compensate for variations in the weight of different users.

While various embodiments have been described, it will be apparent to those of ordinary skill in the art that many more embodiments and implementations are possible within the scope of the disclosure. Accordingly, the invention is not to be restricted.

The invention claimed is:

1. A chair mat designed for use in both a seating and standing position comprising: a substantially rigid base including an upper surface and a lower surface, a fold line separating a first portion of the base from a second portion of the base, and a resilient cushion disposed only on the second portion lower surface, the second portion being movable about the fold line relative to the first portion between a first position where the cushion is downwardly facing and a second position where the cushion is upwardly facing, wherein the fold line comprises a foot, the foot extending away from the lower surface of the rigid base to engage a surface upon which the chair mat is positioned when the cushion is downwardly facing.

2. The chair mat of claim 1, wherein the lower surface of the first portion of the base further comprises a plurality of ribs to engage a smooth surface or a roughened surface upon which the chair mat is positioned.

3. The chair mat of claim 1, wherein the base consists essentially of a thermoplastic, PVC or polypropylene.

4. The chair mat of claim 1, wherein the cushion consists essentially of a foam polymer selected from TPU, EVA, PE, PP, PVC, and natural or synthetic rubber.

5. The chair mat of claim 4, wherein the cushion includes a protective and/or decorative skin coating, and is fixedly coupled on the second portion lower surface.

6. The chair mat of claim 1, wherein the cushion comprises a molded plastic article mechanically designed to give anti-fatigue properties, and produced from a material selected from PVC, EVA, Olefin, TPU, and natural or synthetic rubber, or alloys of PVC, EVA, Olefin, TPU, and natural or synthetic rubber.

7. A chair mat designed for use in both a seating and standing position comprising: a substantially rigid base including an upper surface and a lower surface, a fold line separating a first portion of the base from a second portion of the base, and a resilient cushion disposed only on the second portion lower surface, the second portion being movable about the fold line relative to the first portion between a first position where the cushion is downwardly facing and a second position where the cushion is upwardly facing, wherein the base is a unitary one-piece sheet of molded plastic.

8. A chair mat designed for use in both a seating and standing position comprising: a substantially rigid base including an upper surface and a lower surface, a fold line separating a first portion of the base from a second portion of the base, and a resilient cushion disposed only on the second portion lower surface, the second portion being movable about the fold line relative to the first portion between a first position where the cushion is downwardly facing and a second position where the cushion is upwardly facing, wherein the cushion has a 25% compression deflection in the range of between about 30 and 35 pounds-per-square inch (psi).

9. The chair mat of claim 8, wherein the fold line comprises a rib and a foot, the foot extending away from the lower surface of the rigid base to engage a surface upon which the chair mat is positioned when the cushion is downwardly facing.

10. A chair mat designed for use in both a seating and standing position comprising: a substantially rigid base formed of a unitary one-piece sheet of molded plastic comprising an upper surface and a lower surface, and being divided by a fold line into a first portion and a second portion, and a resilient cushion present only on the lower surface of the second portion, wherein the fold line provides movement of the second portion of the base between a first position where the resilient cushion faces a floor surface upon which the chair mat is positioned, and a second position where the resilient cushion faces an opposite direction away from the floor surface upon which the chair mat is positioned.

11. The chair mat of claim 10, wherein the fold line operates as a hinge mechanism to separate the first portion of the base from the second portion of the base such that the second portion is moveable about the fold line between the first position and the second position.

12. The chair mat of claim 10, wherein the fold line comprises a foot that extends from the lower surface to the floor surface when the second portion is in the first position, and extends in the opposite direction when the second portion is in the second position.

13. The chair mat of claim 12, wherein the foot is formed to include a base and a protruding end, the base coupled with the lower surface, and the protruding end extending away from the lower surface to a distance substantially equal to a thickness of the resilient cushion.

14. The chair mat of claim 10, wherein the resilient cushion is fixedly coupled only to the second portion lower surface.

15. The chair mat of claim 10, wherein only the first portion of the base includes a plurality of ribs to maintain the position of the first portion of the base on the floor surface.

16. The chair mat of claim 15, wherein ribs are integrally formed in the lower surface of the first portion of the base in a plurality of rows extending between a first peripheral edge of the first portion and a second peripheral edge of the first portion.

17. The chair mat of claim 10, wherein ribs are formed as triangular projections that extend away from the lower surface of the first portion of the base.

18. The chair mat of claim 10, wherein the lower surface of the first portion of the base is generally planar so as to be suitable for use on a smooth surface floor.

19. The chair mat of claim 10, wherein the fold line is an integral part of the base and both the base and the fold line consist essentially of a thermoplastic, such as PVC or polypropylene.

20. A chair mat for use in conjunction with a work desk adapted for use in both the standing and the sitting position, the chair mat including a substantially rigid base having an upper surface and a lower surface, a fold line separating a first portion of the base from a second portion of the base, the fold line being situated on the chair mat to be positionable vertically below a front edge of a work desk, and a resilient cushion fixed only to the second portion lower surface, the second portion being movable about the fold line relative to the first portion between a first position where the cushion is downwardly facing a floor surface upon which the chair mat is positioned, and a second position where the cushion is upwardly facing away from the floor surface, wherein the fold line comprises a rib and a foot that extends from the lower surface to the floor surface when the second portion is in the first position, and extends in the opposite direction when the second portion is in the second position.

* * * * *